US007250855B2

(12) United States Patent
Suenbuel et al.

(10) Patent No.: US 7,250,855 B2
(45) Date of Patent: Jul. 31, 2007

(54) FALSE ALARM MITIGATION USING A SENSOR NETWORK

(75) Inventors: Asuman Suenbuel, San Jose, CA (US); Thomas Odenwald, Redwood City, CA (US); Brian S. Mo, Palo Alto, CA (US)

(73) Assignee: SAP Aktiengesellschaft, Walldorf (DE)

( * ) Notice: Subject to any disclaimer, the term of this patent is extended or adjusted under 35 U.S.C. 154(b) by 178 days.

(21) Appl. No.: 11/023,081

(22) Filed: Dec. 27, 2004

(65) Prior Publication Data

US 2006/0152355 A1 Jul. 13, 2006

(51) Int. Cl.
*G08B 29/00* (2006.01)

(52) U.S. Cl. ..... 340/511; 340/525; 700/79; 700/80

(58) Field of Classification Search ..... 340/511
See application file for complete search history.

(56) References Cited

U.S. PATENT DOCUMENTS 4,124,848 A * 11/1978 Clark et al. ..... 340/524
4,514,720 A * 4/1985 Oberstein et al. ..... 340/511
4,668,939 A * 5/1987 Kimura et al. ..... 340/521
4,765,142 A * 8/1988 Nakhamkin ..... 60/652
5,079,422 A * 1/1992 Wong ..... 340/577
5,486,811 A * 1/1996 Wehrle et al. ..... 340/522
5,552,763 A * 9/1996 Kirby ..... 340/506
5,748,098 A * 5/1998 Grace ..... 370/242
6,356,204 B1 * 3/2002 Guindi et al. ..... 340/690
6,492,901 B1 * 12/2002 Ridolfo ..... 340/506
7,098,784 B2 * 8/2006 Easley et al. ..... 340/539.13
2001/0052087 A1 * 12/2001 Garg et al. ..... 714/37
2005/0203881 A1 * 9/2005 Sakamoto et al. ..... 707/3

OTHER PUBLICATIONS

Gregory T. Huang, Casting the Wire, Technology Review, Jul./Aug. 2003, pp. 50-56.
Deborah A. Cafarelli, R. John Hansman , "Effect of False Alarm Rate on Pilot Use and Trust of Automation Under Conditions of Simulated High Risk", Sep. 22, 1998.
Kuchar, J.K., and Hansman, R.J., "A Unified Methodology for the Evaluation of Hazard Alerting Systems," MIT Aeronautical Systems Laboratory Report, ASL-95-1, Jan. 1995.

* cited by examiner

*Primary Examiner*—Benjamin C. Lee
*Assistant Examiner*—Eric M. Blount
(74) *Attorney, Agent, or Firm*—Fish & Richardson P.C.

(57) ABSTRACT

Methods and apparatus, including computer program products, for processing, at a sensor node within a sensor network, a set of sensor readings to determine whether an event has occurred, the set of sensor readings including one or more sensor readings for corresponding environmental conditions. The processing includes determining whether a sensor reading exceeds its corresponding threshold value for an environmental condition, and if so, comparing the set of sensor readings with a history log file to determine whether a false alarm event has occurred. The history log file includes one or more sets of historic sensor readings for corresponding environmental conditions, each set being associated with an environmental situation.

18 Claims, 4 Drawing Sheets

FALSE ALARM MITIGATION USING A SENSOR NETWORK

BACKGROUND

This description relates to false alarm mitigation using a sensor network.

A sensor network is formed by a collection of sensor nodes that are linked by a wireless medium to perform distributed sensing tasks. Sensor networks are deployed in a variety of environments to perform tasks such as surveillance, widespread environmental sampling, security, and health monitoring.

SUMMARY

In general, in one aspect, the invention features a method performed at a sensor node within a sensor network, which includes processing a set of sensor readings to determine whether an event has occurred, the set of sensor readings including one or more sensor readings for corresponding environmental conditions. The processing includes determining whether a sensor reading exceeds its corresponding threshold value for an environmental condition, and if so, comparing the set of sensor readings with a history log file to determine whether a false alarm event has occurred.

Implementations may include one or more of the following. The method includes receiving sensed data from a plurality of sensors; and processing the sensed data to generate the set of sensor readings. One or more of the plurality of sensors are located on one or more remote sensor nodes within the sensor network. The method includes identifying an environmental situation for the sensor node. The method includes selecting a set of threshold values associated with the identified environmental situation, the selected set including threshold values for corresponding environmental conditions; and comparing the set of sensor readings with the selected set of threshold values to determine whether a sensor reading exceeds its corresponding threshold value for an environmental condition. The method includes comparing the set of sensor readings with one or more sets of ideal values, each set including ideal values for corresponding environmental conditions given an environmental situation; and identifying the environmental situation for the sensor node based on the comparison. The history log file includes one or more sets of historic sensor readings for corresponding environmental conditions, each set being associated with an environmental situation. The method includes generating an alert if the determination is made that a false alarm event has not occurred; and sending the alert to a remote computing system. The alert includes a sensor node identifier and the set of sensor readings.

In general, in another aspect, the invention features a computer program product, tangibly embodied in an information carrier, the computer program product being operable to cause a machine to process a set of sensor readings to determine whether an event has occurred, the set of sensor readings including one or more sensor readings for corresponding environmental conditions. The product is operable to cause the machine to process by determining whether a sensor reading exceeds its corresponding threshold value for an environmental condition, and if so, comparing the set of sensor readings with a history log file to determine whether a false alarm event has occurred.

Implementations may include one or more of the following. The computer program product is further operable to cause a machine to receive sensed data from a plurality of sensors; and process the sensed data to generate the set of sensor readings. The computer program product is further operable to cause a machine to receive sensed data from one or more sensor located on one or more remote sensor nodes within the sensor network. The computer program product is further operable to cause a machine to identify an environmental situation for the sensor node. The computer program product is further operable to cause a machine to select a set of threshold values associated with the identified environmental situation, the selected set including threshold values for corresponding environmental conditions; and compare the set of sensor readings with the selected set of threshold values to determine whether a sensor reading exceeds its corresponding threshold value for an environmental condition. The computer program product is further operable to cause a machine to compare the set of sensor readings with one or more sets of ideal values, each set including ideal values for corresponding environmental conditions given an environmental situation; and identify the environmental situation for the sensor node based on the comparison. The history log file includes one or more sets of historic sensor readings for corresponding environmental conditions, each set being associated with an environmental situation. The computer program product is further operable to cause a machine to generate an alert if the determination is made that a false alarm event has not occurred; and send the alert to a remote computing system. The alert includes a sensor node identifier and the set of sensor readings.

In general, in another aspect, the invention features a system including a memory in which a plurality of data sets are stored, the plurality of data sets including one or more sets of historic sensor readings and one or more sets of threshold values, each data set being associated with an environmental situation; and a processor to execute a program configured to identify an environmental situation for the sensor node; determine whether a set of sensor readings fails to satisfy the set of threshold values associated with the identified environmental situation, and if so, compare the set of sensor readings with one or more sets of historic sensor readings to determine whether a false alarm event has occurred.

Implementations may include one or more of the following. The program is configured to receive sensed data from a plurality of sensors; and process the sensed data to generate the set of sensor readings.

Advantages that can be seen in particular implementations of the invention include one or more of the following. The sensor network can be used to mitigate false alarms that may occur in, e.g., a cargo container in which sensor nodes of the sensor network are deployed. A sensor node can be programmed to store multiple data sets including sets of threshold values for environmental conditions and sets of historic sensor readings. The sensor node uses the data sets to dynamically select the threshold values used for comparison with sensor readings generated by the sensor node. In this manner, the sensor node can account for different environmental situations in which the cargo container may encounter, and raise an alert only if the cargo container is experiencing an unusual occurrence (e.g., excessive vibration) given its environmental situation. If an alert is raised, the sensor node uses the data sets to determine whether the sensor readings triggering the alert correspond with any one of a number of sets of historic sensor readings that have previously been confirmed (e.g., via human input) as being false alarm events. In this manner, the sensor node can mitigate false alarms and generate alerts that indicate a high probability of a dangerous situation that requires immediate attention from company personnel.

The details of one or more examples are set forth in the accompanying drawings and the description below. Further features, aspects, and advantages of the invention will become apparent from the description, the drawings, and the claims.

DETAILED DESCRIPTION

Figure 1A:
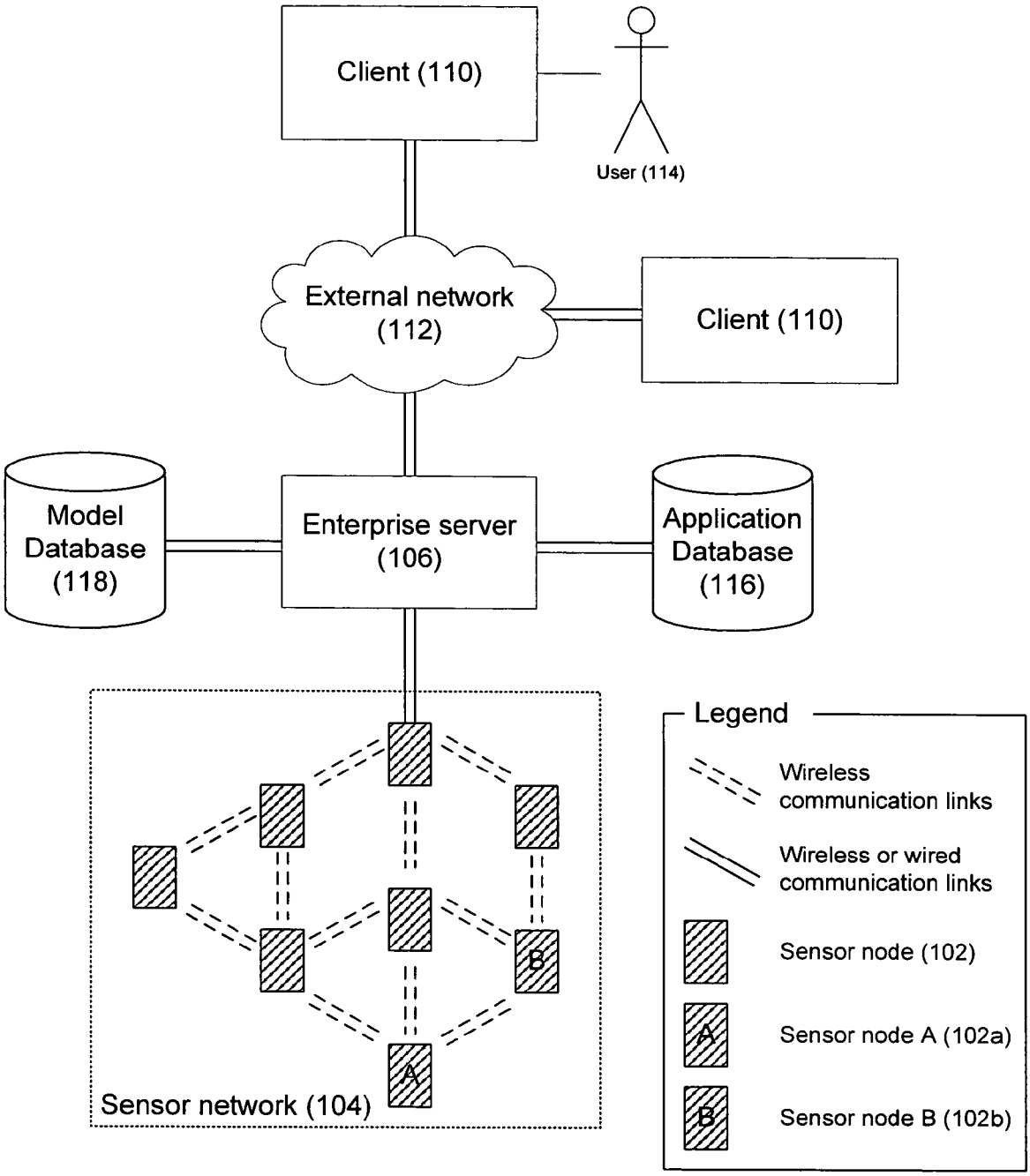
FIG. 1*a* is a block diagram of a system for monitoring an environment using a sensor network.
Figure 1B:
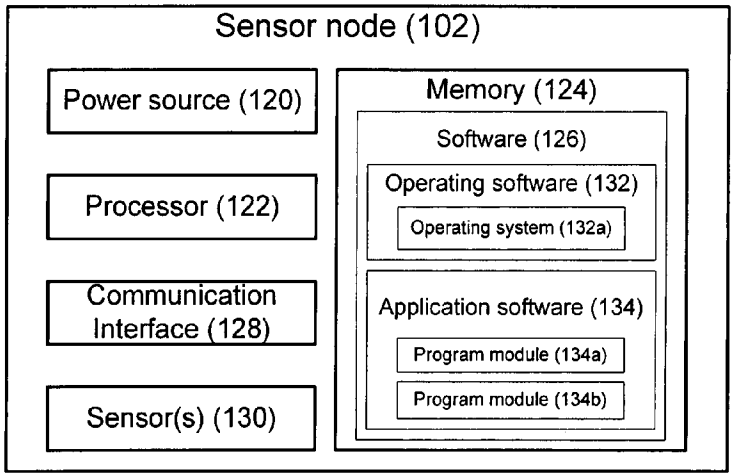
FIG. 1*b* is a block diagram of a sensor node.
Figure 1D:
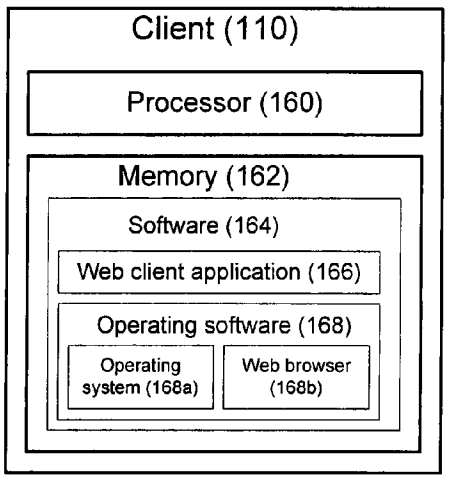
FIG. 1*d* is a block diagram of a client.
Figure 1C:
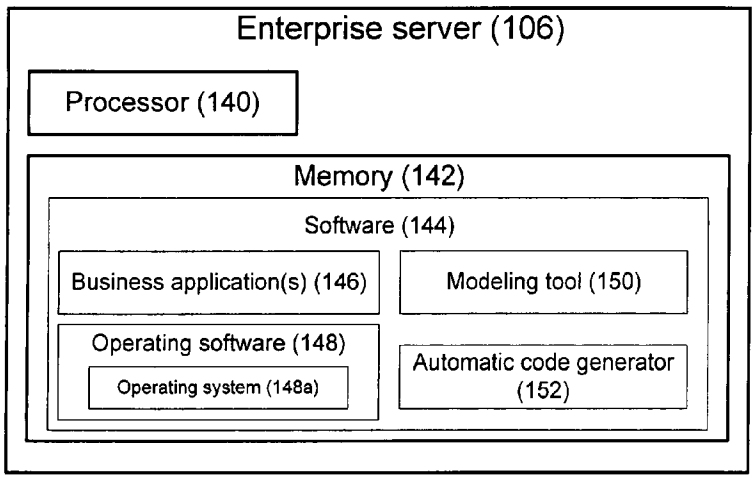
FIG. 1*c* is a block diagram of an enterprise server.

Referring to FIGS. 1*a*-1*d*, a distributed collection of sensor nodes 102 forms a sensor network 104 interconnected by wireless communications links (represented by double dashed lines). Each sensor node 102 senses and collects data samples from its physical environment. The sensor nodes 102 perform routing functions to create a multi-hop wireless networking fabric that relays data samples to an enterprise server 106. The enterprise server 106 receives the information gathered by the sensor network 104, performs additional processing (if necessary), and delivers the information to one or more clients 110 over an external network 112. Through a user interface provided at the client 110, a user 114 may interact with the sensor network 104 by, e.g., viewing the activity of the sensor nodes 102 at a node-level or a network-level, determining the health status (e.g., battery level) of individual sensor nodes 102, issuing commands to set sensor sensitivity thresholds of the sensor nodes 102 or reprogram individual sensor nodes 102, to name a few.

Each sensor node 102 is an electronic device having processing, sensing, and communication capability. Each sensor node 102 includes a power source 120 (e.g., a battery), one or more processors (referred to herein as "processor 122"), a memory 124 for storing software 126, a communication interface 128, and one or more sensors 130. The communication interfaces 128 of sensor nodes that are not directly connected to the enterprise server 106 typically only include a wireless component (e.g., an antenna). For sensor nodes 102 that serve as gateways between the sensor network 104 and the enterprise server 106, the communication interface 128 includes both a wireless component and a wired component (e.g., Ethernet jack).

The processor 122 of a sensor node 102 executes the software 126, which includes operating software 132 and application software 134. The operating software 132 includes an operating system 132*a*, such as TinyOS (developed at the University of California, Berkeley). The application software 134 includes one or more program modules 134*a*, 134*b*. Each program module 134*a*, 134*b* includes executable code that is either loaded into memory 124 prior to deployment of the sensor node, or received over the wireless communication links post-deployment. Such post-deployment programming enables a sensor node 102 embedded in the environment to be programmed (or reprogrammed) on-the-fly, thus providing for application upgrades or changes, and in some cases, recovery from program-induced crashes or failures, e.g., through remote rebooting.

Each sensor node 102 includes one or more sensors 130 for detecting different environmental conditions including, but not limited to, acceleration, vibration, temperature, sound and light, movement and proximity to other sensor nodes 102. The sensed raw data resulting from the detection can be processed and analyzed autonomously or in cooperation with neighboring sensor nodes 102 to generate filtered sensor readings. The filtered sensor readings are then passed from sensor node to sensor node on a multi-hop route to the enterprise server 106. Communicating filtered sensor readings rather than a continuous stream of raw data between the sensor nodes 102 reduces the power required to convey information within the sensor network 104.

The enterprise server 106 may be any type of computing device including a processor 140 and memory 142 that stores software 144. The processor 140 executes software 144, which includes one or more business applications 146 and operating software 148. The operating software 148 includes, but is not limited to, an operating system 148*a* and one or more routines for effecting communication over the external network 112. In one example, the enterprise server 106 is an SAP Web Application Server 106 running mySAP Product Lifecycle Management ("PLM") business application software 146, both available from SAP AG of Walldorf (Baden) Germany. The mySAP PLM business application 146 can be used for life-cycle data management, program and product management, life-cycle collaboration, quality management, asset life-cycle management, and environment, health and safety management.

Data associated with the business application 146 is stored in an application database 116 accessible by the enterprise server 106. Although only one application database 116 is shown in FIG. 1, the depicted single application database 116 represents any physical or virtual, centralized or distributed database suitable for the receipt and storage of files. Each file is an entity of data, i.e., a string of bytes that is capable of being manipulated as an entity. The files can represent any kind of information, such as text, images, executables, or simply binary data.

The external network 112 may be comprised of one or more networks, such as wide area networks ("WANs"), LANs, wireless networks, and the like, which may or may not be linked by the Internet. The external network 112 runs transmission control protocol/internet protocol ("TCP/IP") or another suitable protocol. Network connections may be via Ethernet, telephone line, wireless, or other transmission media.

Each client 110 may be any type of Web-enabled apparatus or system. Examples of such apparatuses or systems include, but are not limited to, a desktop computer, a laptop computer, a mainframe computer, a cellular telephone, a personal digital assistant ("PDA"), and a controller embedded in an otherwise non-computing device. The client 110 contains one or more processor(s) 160 (referred to simply as "processor 160") and memory 162 for storing software 164. The processor 160 executes software 164, which includes a Web client application 166 and operating software 168. The Web client application 166 includes one or more routines used in implementing the TCP/IP protocol, which allows the client 110 to communicate over the external network 112. The operating software 168 may include an operating system 168*a*, such as Windows XP®, a Web browser 168*b*, such as Internet Explorer®, and various application programs.

Although sensor networks 104 can be used in a wide variety of application domains including geophysical monitoring, precision agriculture, habitat monitoring, condition-based equipment maintenance, supply chain management, asset tracking, and healthcare monitoring, a deployed sensor network 104 typically targets a single application domain and is tailored to the domain's needs.

In one example scenario, a chemical manufacturing company handles hundreds of different raw materials and manufactures thousands of end products. The company uses the environment, health, and safety ("EH&S") management capability of the mySAP PLM application 146 to provide an enterprise solution that enables the company to manage its EH&S processes globally while ensuring that the requirements of EH&S laws and regulations are continually updated and satisfied by company procedures.

The company maintains an application database 118 that includes information, for each raw material and/or end product, such as composition, physical data (melting point, boiling point, flash point etc.), toxicity, health effects, first aid, reactivity, storage, disposal, protective equipment, and spill/leak procedures. The information in the application database 118 can be updated to reflect changes in the law and the mySAP PLM application 146 maintains a log of such changes for record keeping purposes. Environmental protection and work safety data can be made available across the company, and comprehensive search and output functions help employees to find information quickly and easily. Furthermore, material data sheets can be easily generated from the data stored in the application database 118. Such material data sheets provide both workers and emergency personnel with the proper procedures for handling or working with a particular substance.

The information stored in the application database 118 can also be used to aid the company in deploying a sensor network 104 that monitors EH&S issues, e.g., when transporting cargo containers of chemical drums containing the raw materials and/or end products. In one implementation, the enterprise server 106 includes a modeling tool 150 for generating a model of a sensor network that monitors a collection of 50 cargo containers to be transported from a first warehouse (referred to as "source warehouse") to a second warehouse (referred to as "destination warehouse") via a combination of ground, sea, and rail transportation. Each cargo container holds up to 20 chemical drums containing raw materials and/or end products of the chemical manufacturing company.

The sensor network model identifies sensor node placement for reliable and efficient collection of sensor readings that may subsequently be processed by the mySAP PLM application 146 to determine, e.g., whether a dangerous situation exists within a cargo container. In this manner, the enterprise server 106 provides an infrastructure that supports a seamless integration of data (in the form of raw or filtered sensor readings) from a deployed sensor network 104 with business applications, such as the mySAP PLM application 146.

Once the sensor network model is generated and approved by the company, a "blueprint" of the sensor network model, specifying the sensor-types and location of each sensor node 102 to be deployed in a cargo container, can be provided to company personnel. The company personnel may then affix sensor nodes 102 to physical objects in each cargo container according to the blueprint. The physical objects may be in fixed locations (e.g., exterior walls, interior walls, floor, and/or ceiling of a cargo container) or portable (e.g., chemical drums themselves). The program modules 134*a*, 134*b* of each sensor node 102 includes executable code that is provided by the enterprise server 106 pre-deployment or post-deployment as previously described.

Figure 2:
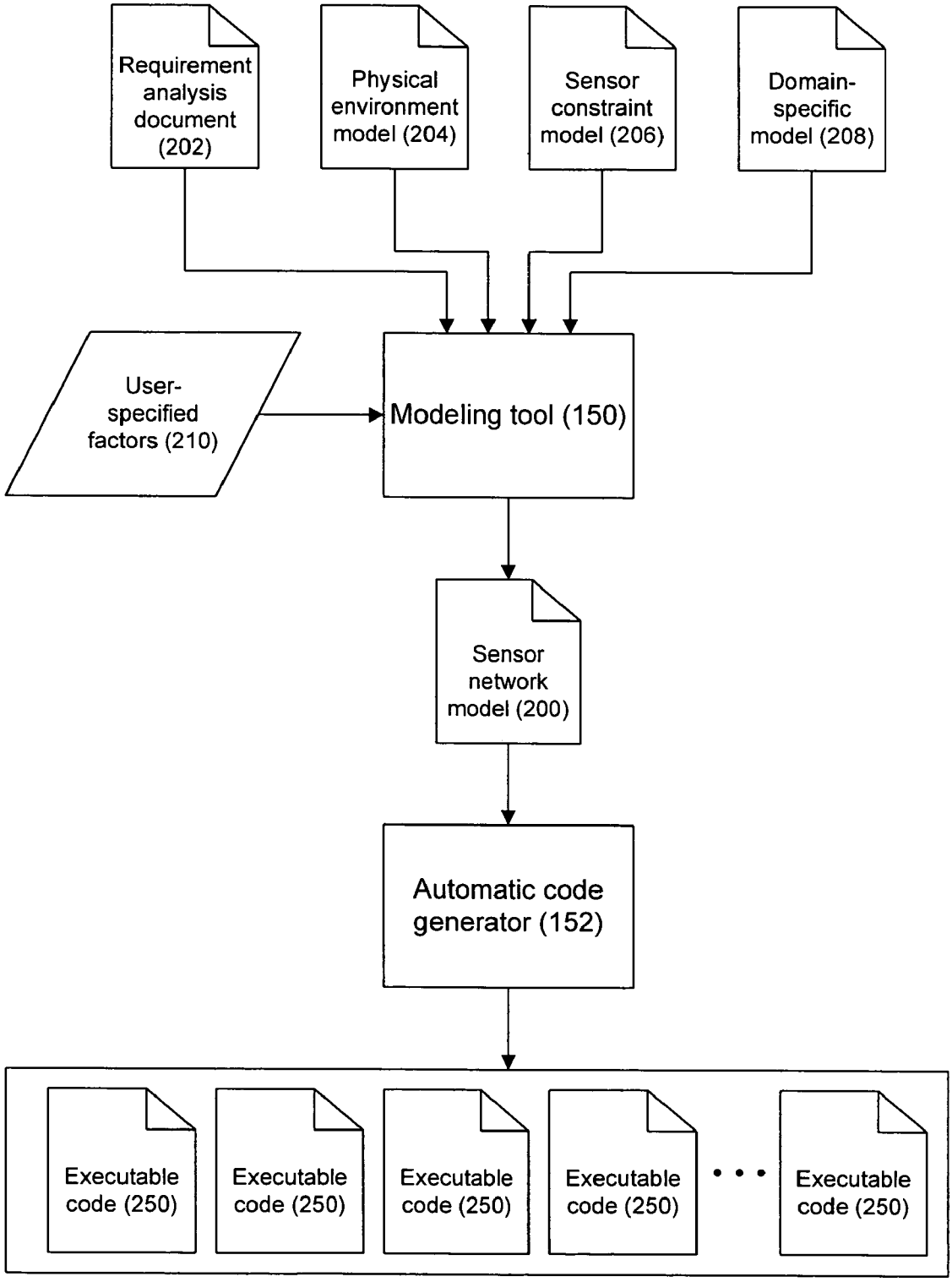
FIG. 2 shows a flowchart of a process for sensor node modeling and deployment.

As shown in FIG. 2, to generate a sensor network model 200, the modeling tool 150 takes an input a requirement analysis document 202, a physical environment model 204, a sensor constraint model 206, and a domain-specific model 208. Each of the models (i.e., the physical environment model 204, the sensor constraint model 206, and the domain-specific model 208) can be pre-built and stored (typically as code in a single file) in a model database 118 for subsequent retrieval by the modeling tool 150. Alternatively, one or more of the models 204-208 can be built by the modeling tool 150 using information provided by a user 114 and/or retrieved from the application database 116. For example, the modeling tool 150 can retrieve information about the raw materials and end products (e.g., composition, physical data, toxicity, and reactivity) as well as laws and regulations governing EH&S issues in a particular country to generate the domain-specific model 208.

Typically, company personnel prepare a requirement analysis document 202 during the early stages of a sensor network deployment life cycle. The requirement analysis document 202 states, in business terms, the needs or objectives of the company that are to be satisfied by deploying a sensor network deployment in the storage facility. Generally, the requirement analysis document 202 includes a collection of requirements expressed in the form of "shall" statements. Each "shall" statement represents a unique and specific requirement that the deployed sensor network will be measured against to ensure conformity to the requirements. An example of a "shall" statement in the storage facility scenario is: "The deployed sensor network shall ensure that EH&S laws and regulations are satisfied." Another example is: "The deployed sensor network shall ensure that company personnel are alerted when a dangerous situation is detected." The "shall" statements essentially function as a task list that specifies the deliverables that would render the deployed sensor network as successful from the company's perspective. A user 114 interacting with the modeling tool 150 can translate the "shall" statements provided in the requirement analysis document 202 to a logical format that is parsable into programming code. In one example, the user translates the "shall" statements into logical statements, each formed by a plurality of variables associated with each other through logical operators. In this manner, a logical representation of the requirement analysis document 202 is generated and may subsequently be used by the modeling tool 150.

A physical environment model 204 defines a physical space in which the sensor network 104 is to be deployed. The physical environment model 204 is used by the modeling tool 150 to identify the physical constraints of the, e.g., cargo containers that have to be accounted for in order to generate an effective sensor network 104. In the example scenario, the physical environment model 204 provides a description (e.g., text and/or graphical) of each type of cargo container that is used for transporting the chemical drums, e.g., in terms of the physical dimensions of the cargo container, the types of materials used to construct the walls, ceiling, and floor of the cargo container, and the type and/or location of insulation (if any).

The physical environment model 204 also provides descriptions of environmental situations that the cargo containers may experience during storage and transportation. Examples of environmental situations include a ground transportation situation, a rail transportation situation, a sea transportation situation, and a warehouse storage situation. Each description of an environmental situation generally includes statements describing environmental conditions that a cargo container may encounter. Environmental conditions can be broadly categorized into climatic environmental conditions and mechanical environmental conditions. Examples of climatic environmental conditions include wind, precipitation, sand and dust, atmospheric salt and brine spray, humidity, solar radiation, high or low temperature, thermal shock, high or low pressure, and gas. Examples of mechanical environmental conditions include shock, vibration, collision, acceleration, and noise.

A sensor constraint model 206 defines constraints that apply at an individual sensor node-level or at a sensor network-level. The sensor constraint model 206 is used by the modeling tool 150 to identify physical, functional and/or operational constraints with respect to the sensors that have to be accounted for in order to generate an effective sensor network 104. In the example scenario, the sensor constraint model 206 accounts for constraints that apply uniformly to all sensor nodes 102 (e.g., battery power, processing capability, memory size, signal range, and network bandwidth), constraints that are sensor-type specific (e.g., the sensing coverage of a temperature sensor as compared to the sensing coverage of a humidity sensor, the directional parameters of a camera sensor), as well as constraints that are network-specific (e.g., arrangement of sensor nodes to provide reliable communication in the event of node outages)

A domain-specific model 208 describes rules that enable a sensor network 104 to be tailored to a specific application domain (e.g., monitoring cargo containers for storing chemical drums as compared to monitoring cargo containers for storing electronic devices). In the example scenario, the domain-specific model 208 includes a set of storage rules regarding storage conditions and incompatible goods. An example storage condition rule requires certain chemical drums to be stored according to a certain temperature or humidity requirements. The incompatible goods rules dictate that certain chemicals that are particularly reactive with each other should not be stored in proximity with each other. The domain-specific model 208 may provide other types and sets of rules.

In one implementation, prior to generating the sensor network model, the modeling tool 150 provides a graphical user interface through which a user 114 selects one or more sensor network factors 210, e.g., cost, maximum number of sensor nodes, maximum number of sensors of a particular type, power consumption per node, aggregate power consumption across the sensor network, and bandwidth efficiency. The modeling tool 150 then takes as input the requirement analysis document 202, the physical environment model 204, the sensor constraint model 206, and the domain-specific model 208, and generates a sensor network model 200 that is optimized based on the user-specified factor(s) 210. In one example sensor network model 200, each sensor node 102 to be deployed is represented in the sensor network model 200 by information including, but not limited to location coordinates and sensor-types.

Once the sensor network model 200 has been generated and approved by the company, the sensor nodes 102 are deployed based on the sensor network model 200. In one implementation, the enterprise server 106 includes an automatic code generator 152 that translates the sensor network model 200 into items of executable code 250. Each item of executable code 250 is associated with a particular sensor node 102 in the sensor network model 200, and may be loaded into the memory 124 of that sensor node 102 pre-deployment or post-deployment.

Each sensor node 102 can be further programmed with data for use in comparison testing. Such data includes multiple sets of threshold values, multiple sets of ideal values, and a false alarm history log file. Each set of threshold values includes threshold values for a number of environmental conditions given a particular environmental situation. The threshold values for a particular environmental condition (e.g., temperature) may vary from set to set. Generally, the threshold values of a set define the upper or lower bounds of the environmental conditions of a cargo container (in which the sensor node is deployed) given the environmental situation. Each set of ideal values includes a combination of ideal values for environmental conditions of a cargo container given a specific environmental situation. As with the threshold values, the ideal values for a particular environmental condition may vary from set to set. In some instances, rather than storing a single ideal value for an environmental condition per set, a range of ideal values may be stored. The false alarm ("FA") history log file includes multiple sets of historic filtered sensor readings. Each set of historic filtered sensor readings includes a combination of filtered sensor readings for environmental conditions of a cargo container given a specific environmental situation. Each set of historic filtered sensor readings corresponds with an event occurring within the sensor network 104 that was subsequently confirmed by company personnel as being a false alarm event.

As previously-discussed, each sensor node can be programmed to process sensed raw data autonomously or in cooperation with neighboring sensor nodes to generate filtered sensor readings. If the processing involves multiple sensors, the sensor node typically processes the sensed raw data by sensor-type in order to generate condition-related filtered sensor readings. Examples of ways in which a vibration-related filter sensor reading may be generated include (but are not limited to) the following:

Processing vibration-related sensed raw data from one or more sensors on a sensor node.

Processing vibration-related sensed raw data from sensors on a number of sensor nodes within a cargo container.

Figure 3:
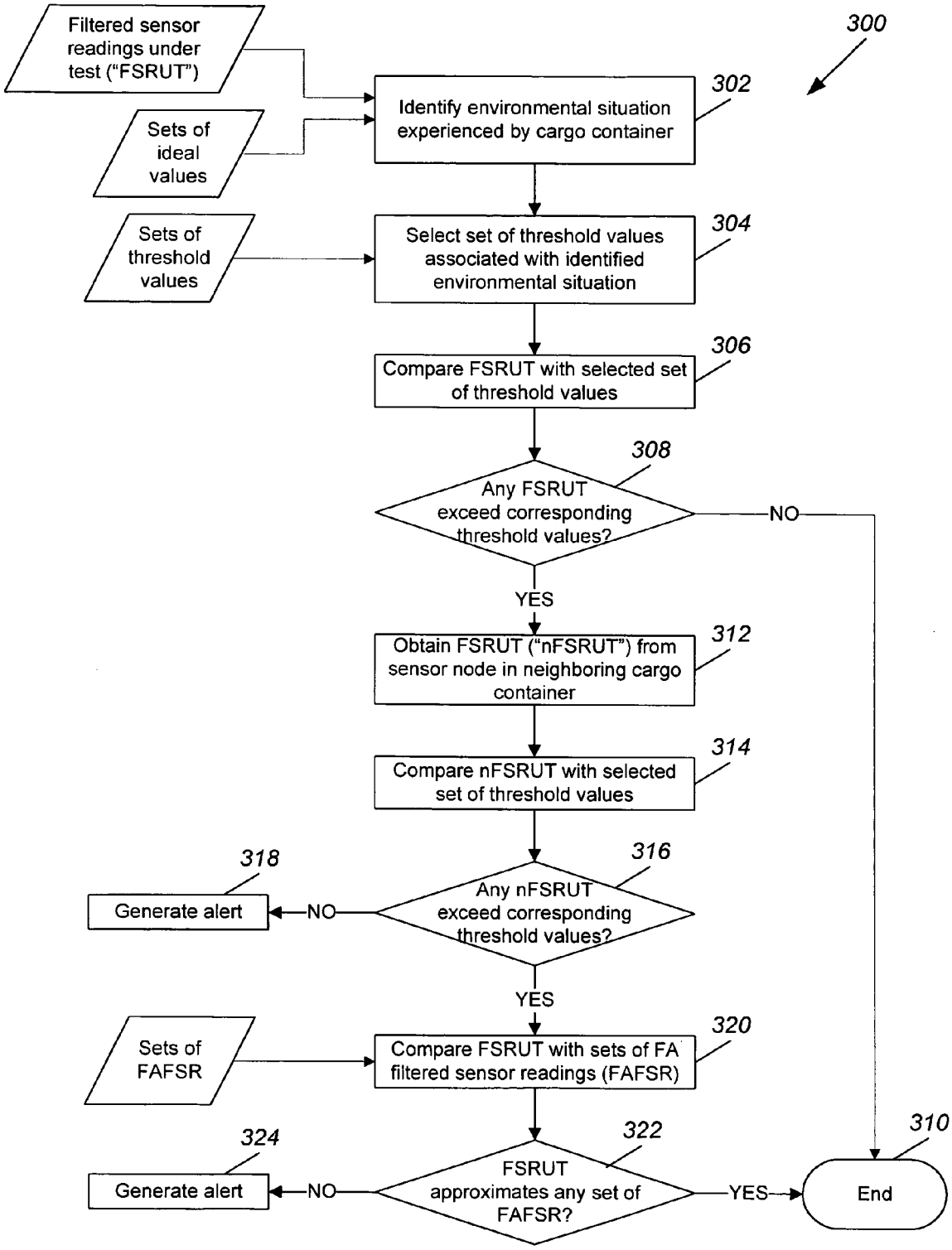
FIG. 3 shows a flowchart of a process for generating an alert.

The filtered sensor readings ("filtered sensor readings under test") may then be analyzed to determine whether an event has occurred within the sensor network 104. FIG. 3 shows one such process 300 implemented by a sensor node A 102*a*. The sensor node A 102*a* first identifies (302) the environmental situation experienced by the cargo container in which it is deployed. The identification may be based on an internal assessment (e.g., comparing the filtered sensor readings under test with sets of ideal values, and based on the comparison, identifying the set of ideal values most similar to filtered sensor readings under test) or an external input (e.g., receiving location information from the enterprise server 106).

The sensor node A 102*a* then selects (304) a set of threshold values based on the identification, and compares (306) the filtered sensor readings under test with corresponding threshold values of the selected set to determine (308) whether any of the filtered sensor readings under test exceed corresponding threshold values. If none of the filtered sensor readings under test exceed corresponding threshold values, the process (300) is terminated (310).

Suppose, for example, that the sensor node A 102*a* identifies the cargo container as experiencing a rail transportation situation. The sensor node A 102*a* retrieves from its memory the set of threshold values associated with the rail transportation system, compares the filtered sensor readings under test with the retrieved set of threshold values, and determines that a vibration-related filtered sensor reading under test exceeds the vibration-related threshold value.

In one implementation, the sensor node A 102*a* automatically generates an alert, which notifies the enterprise server 106 that a dangerous situation may exist within the cargo container.

In the illustrated implementation, the sensor node A 102*a* obtains (312) a vibration-related filtered sensor reading from a sensor node B 102*b* in a neighboring cargo container, e.g., by sending a message to the sensor node B requesting its most recent vibration-related filtered sensor reading. Upon receipt, the sensor node A 102*a* compares (314) the vibration-related filtered sensor reading from sensor node B 102*b* with the vibration-related threshold value (from 304) to determine (316) whether the vibration-related filtered sensor reading from sensor node B 102*b* exceeds the vibration-related threshold value.

An alert is generated (318) by the sensor node A 102*a* if the vibration-related filtered sensor reading from sensor node B 102*b* does not exceed the vibration-related threshold value as this is an indication that the cargo container in which the sensor node A 102*a* is deployed is experiencing a unique instance of excessive vibration.

If, however, the vibration-related filtered sensor reading from sensor node B 102*b* exceeds the vibration-related threshold value, the sensor node A 102*a* compares (320) the set of filtered sensor readings under test with the FA history log file to determine (322) whether the set of filtered sensor readings under test closely approximates any of the sets of historic filtered sensor readings given the same environmental situation. If so, the sensor node A 102*a* terminates (310) the process (300), unless there is an indication that the excessive vibrations has persisted for a prolonged period of time, in which case an alert may be generated by the sensor node A 102*a*. If, however, the set of filtered sensor readings under test does not closely approximate any of the sets of historic filtered sensor readings, an alert is generated (324) by the sensor node A 102*a*.

In addition to providing a sensor node identifier that enables company personnel to subsequently locate the sensor node 102 that generated the alert, the alert may include information such as a time-stamp, the set of filtered sensor readings under test, and an environmental situation identifier. Such information can be collected by the enterprise server 106 and added to an alert history log file for the sensor node 102, cargo container, sensor network 104, or some combination thereof. Once company personnel has investigated the situation arising from the alert, feedback may be provided to the enterprise server 106 to confirm whether a dangerous situation indeed existed in the cargo container or whether a false alarm was raised. In the event of a false alarm, the information provided in the alert may be added to the FA history log file.

The techniques and all of the functional operations described in the attached documentation can be implemented in digital electronic circuitry, or in computer software, firmware, or hardware, including the structural means disclosed in this specification and structural equivalents thereof, or in combinations of them. The techniques can be implemented as one or more computer program products, i.e., one or more computer programs tangibly embodied in an information carrier, e.g., in a machine-readable storage device or in a propagated signal, for execution by, or to control the operation of, data processing apparatus, e.g., a programmable processor, a computer, or multiple computers. A computer program (also known as a program, software, software application, or code) can be written in any form of programming language, including compiled or interpreted languages, and it can be deployed in any form, including as a stand-alone program or as a module, component, subroutine, or other unit suitable for use in a computing environment. A computer program does not necessarily correspond to a file. A program can be stored in a portion of a file that holds other programs or data, in a single file dedicated to the program in question, or in multiple coordinated files (e.g., files that store one or more modules, sub-programs, or portions of code). A computer program can be deployed to be executed on one computer or on multiple computers at one site or distributed across multiple sites and interconnected by a communication network.

The processes and logic flows described in this specification, including the method steps of the techniques, can be performed by one or more programmable processors executing one or more computer programs to perform functions of the techniques by operating on input data and generating output. The processes and logic flows can also be performed by, and apparatus of the techniques can be implemented as, special purpose logic circuitry, e.g., an FPGA (field programmable gate array) or an ASIC (application-specific integrated circuit).

Processors suitable for the execution of a computer program include, by way of example, both general and special purpose microprocessors, and any one or more processors of any kind of digital computer. Generally, a processor will receive instructions and data from a read-only memory or a random access memory or both. The essential elements of a computer are a processor for executing instructions and one or more memory devices for storing instructions and data. Generally, a computer will also include, or be operatively coupled to receive data from or transfer data to, or both, one or more mass storage devices for storing data, e.g., magnetic, magneto-optical disks, or optical disks. Information carriers suitable for embodying computer program instructions and data include all forms of non-volatile memory, including by way of example semiconductor memory devices, e.g., EPROM, EEPROM, and flash memory devices; magnetic disks, e.g., internal hard disks or removable disks; magneto-optical disks; and CD-ROM and DVD-ROM disks. The processor and the memory can be supplemented by, or incorporated in, special purpose logic circuitry.

The techniques can be implemented in a computing system that includes a back-end component (e.g., a data server), a middleware component (e.g., an application server), or a front-end component (e.g., a client computer having a graphical user interface or a Web browser through which a user can interact with an implementation of the techniques), or any combination of such back-end, middleware, and front-end components. The components of the system can be interconnected by any form or medium of digital data communication, e.g., a communication network. Examples of communication networks include a local area network ("LAN") and a wide area network ("WAN"), e.g., the Internet.

The computing system can include clients and servers. A client and server are generally remote from each other and typically interact through a communication network. The relationship of client and server arises by virtue of computer programs running on the respective computers and having a client-server relationship to each other.

Other embodiments are within the scope of the following claims. The following are examples for illustration only and not to limit the alternatives in any way. The techniques described herein can be performed in a different order and still achieve desirable results. Although the techniques are described using cargo container transportation examples, the techniques described herein can be used to mitigate false alarms using sensor networks that deployed in any number of environments.

What is claimed is:

1. A method comprising:

selecting one of a plurality of sets of threshold values based on an identified environmental situation for a sensor node within a sensor network, the selected set including threshold values for corresponding environmental conditions; and processing a set of sensor readings to determine whether an event has occurred given the identified environmental situation for the sensor node, the set of sensor readings comprising one or more sensor readings for corresponding environmental conditions, the processing comprising determining whether a sensor reading exceeds a corresponding threshold value for an environmental condition, and if so, comparing the set of sensor readings with a history log file to determine whether a false alarm event has occurred, wherein the selecting and the processing are performed by the sensor node.

2. The method of claim 1, further comprising:

receiving sensed data from a plurality of sensors; and processing the sensed data to generate the set of sensor readings.

3. The method of claim 2, wherein one or more of the plurality of sensors are located on one or more remote sensor nodes within the sensor network.

4. The method of claim 1, further comprising:

identifying an environmental situation for the sensor node.

5. The method of claim 4, wherein identifying the environmental situation comprises:

comparing the set of sensor readings with one or more sets of ideal values, each set including ideal values for corresponding environmental conditions given an environmental situation; and identifying the environmental situation for the sensor node based on the comparison.

6. The method of claim 1, wherein the history log file comprises one or more sets of historic sensor readings for corresponding environmental conditions, each set being associated with an environmental situation.

7. The method of claim 1, further comprising:

generating an alert if the determination is made that a false alarm event has not occurred; and sending the alert to a remote computing system.

8. The method of claim 7, wherein the alert comprises a sensor node identifier and the set of sensor readings.

9. A computer program product, tangibly embodied in an information carrier, the computer program product being operable to cause a machine at a sensor node within a sensor network to:

select one of a plurality of sets of threshold values based on an identified environmental situation for a sensor node within a sensor network, the selected set including threshold values for corresponding environmental conditions; and process a set of sensor readings to determine whether an event has occurred given the identified environmental situation for the sensor node, the set of sensor readings comprising one or more sensor readings for corresponding environmental conditions, the product being operable to cause the machine to process by:

determining whether a sensor reading exceeds its corresponding threshold value for an environmental condition, and if so, comparing the set of sensor readings with a history log file to determine whether a false alarm event has occurred.

10. The computer program product of claim 1, being further operable to cause a machine to:

receive sensed data from a plurality of sensors; and process the sensed data to generate the set of sensor readings.

11. The computer program product of claim 10, being further operable to cause a machine to:

receive sensed data from one or more sensor located on one or more remote sensor nodes within the sensor network.

12. The computer program product of claim 9, being further operable to cause a machine at the sensor node to:

identify an environmental situation for the sensor node.

13. The computer program product of claim 12, being further operable to cause a machine to:

compare the set of sensor readings with one or more sets of ideal values, each set including ideal values for corresponding environmental conditions given an environmental situation; and identify the environmental situation for the sensor node based on the comparison.

14. The computer program product of claim 9, wherein the history log file comprises one or more sets of historic sensor readings for corresponding environmental conditions, each set being associated with an environmental situation.

15. The computer program product of claim 9, being further operable to cause a machine to:

generate an alert if the determination is made that a false alarm event has not occurred; and send the alert to a remote computing system.

16. The computer program product of claim 15, wherein the alert comprises a sensor node identifier and the set of sensor readings.

17. A system including a sensor node, the system comprising:

memory in which a plurality of data sets are stored, the plurality of data sets comprising one or more sets of historic sensor readings and one or more sets of threshold values, each data set being associated with an environmental situation; and a processor to execute a program configured to:

identify an environmental situation for the sensor node;

select one of a plurality of sets of threshold values based on the identified environmental situation, the selected set including threshold values for corresponding environmental conditions; and determine whether a set of sensor readings fails to satisfy the selected set of threshold values associated with the identified environmental situation, and if so, compare the set of sensor readings with one or more sets of historic sensor readings to determine whether a false alarm event has occurred.

18. The system of claim 17, wherein the program is further configured to:

receive sensed data from a plurality of sensors; and process the sensed data to generate the set of sensor readings.

* * * * *